US005243492A

United States Patent [19]

Marquit et al.

[11] Patent Number: 5,243,492

[45] Date of Patent: Sep. 7, 1993

[54] PROCESS FOR FABRICATING A HERMETIC COAXIAL FEEDTHROUGH

[75] Inventors: Robert J. Marquit; Douglass R. Gooch; James E. Knight, all of Golden, Colo.

[73] Assignee: Coors Ceramics Company, Golden, Colo.

[21] Appl. No.: 937,349

[22] Filed: Aug. 27, 1992

[51] Int. Cl.[5] ..... F23Q 7/00; B60R 21/26; G01V 1/06

[52] U.S. Cl. ..... 361/247; 361/248; 102/202.9; 280/736

[58] Field of Search ..... 361/302, 306, 307, 320, 361/247, 248; 29/25.42, 628; 102/70.2, 28, 202.9; 180/103 AB; 280/736

[56] References Cited

U.S. PATENT DOCUMENTS

| | | | |
|---|---|---|---|
| 3,971,320 | 7/1976 | Lee | 102/28 R |
| 3,983,624 | 10/1976 | Gross | 102/28 R X |
| 4,810,849 | 3/1989 | Heideman | 219/89 |
| 5,026,963 | 6/1991 | Saito et al. | 219/89 |
| 5,140,906 | 8/1992 | Little | 102/202.14 |

FOREIGN PATENT DOCUMENTS

| | | | |
|---|---|---|---|
| 52-30947 | 8/1977 | Japan | 901/42 |
| 63-299866 | 12/1988 | Japan | 219/86.25 |
| 2-92472 | 4/1990 | Japan | 219/90 |
| 1386406 | 4/1988 | U.S.S.R. | 219/90 |

*Primary Examiner*—Bruce A. Reynolds
*Assistant Examiner*—Michael D. Switzer
*Attorney, Agent, or Firm*—Sheridan Ross & McIntosh

[57] ABSTRACT

The present invention relates to a process for fabricating a hermetic coaxial feedthrough device wherein a pin is substantially centered within the device. The pin can be electrically connected to the outer portion of the device via a bridge wire to form a header that is particularly useful for igniting a gas-generating composition in an air bag device. The invention also provides an eyelet useful in the process and an improved header device having a substantially smooth surface.

44 Claims, 2 Drawing Sheets

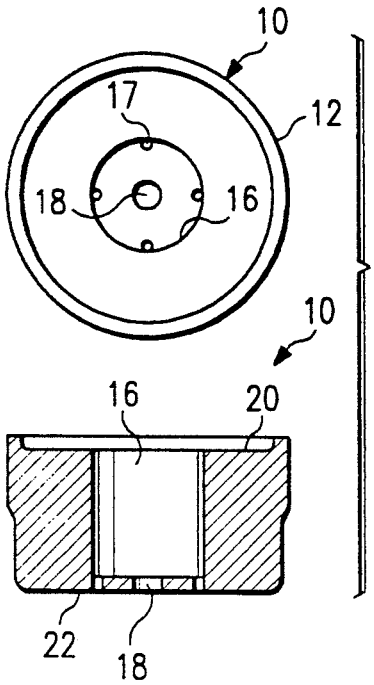
FIG. 1
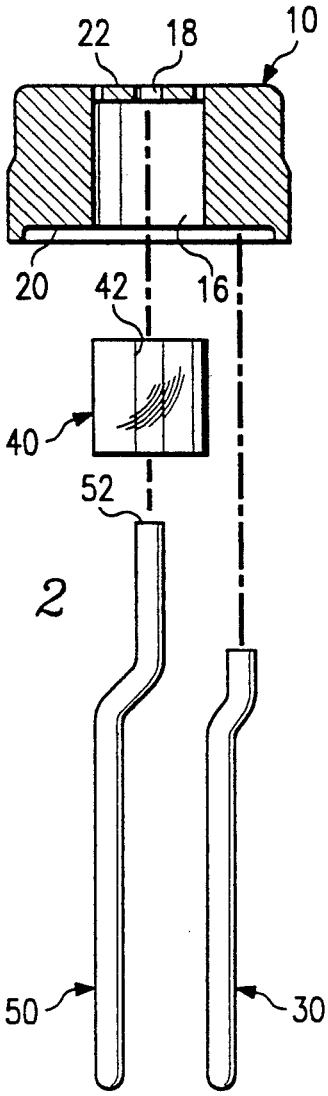
FIG. 2
FIG. 3b
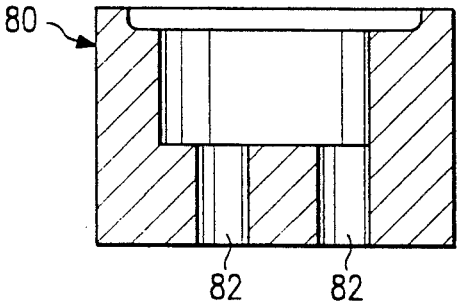
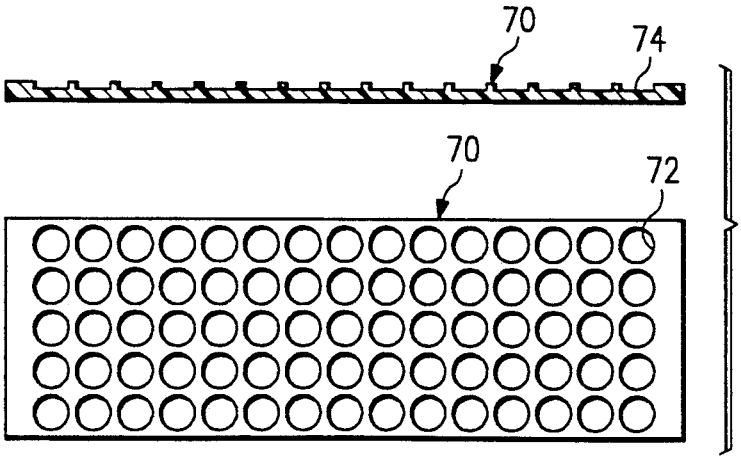
FIG. 3a

PROCESS FOR FABRICATING A HERMETIC COAXIAL FEEDTHROUGH

FIELD OF THE INVENTION

The present invention relates to a process for fabricating an electronic device having a pin hermetically sealed in a glass, wherein the pin can be centered within the device to form a coaxial feedthrough. More particularly, the present invention relates to a process for fabricating an explosive trigger device, or header, that is particularly useful in passenger vehicle air bags.

BACKGROUND OF THE INVENTION

With the increasing demand for automobile safety, automobile manufacturers have begun to equip passenger automobiles with air bags to enhance passenger safety. Air bags are devices that rapidly inflate with a gas when a detector on the automobile senses a collision. These passenger restraint systems are well-known in the art as described, for example, in U.S. Pat. No. 3,723,205 and U.S. Pat. No. 4,981,534, both by Scheffe, and incorporated herein by reference in their entirety. These devices should be designed with the highest degree of safety reasonably achievable to insure that the device will function properly at all times.

Inflation of the air bag can be accomplished by means of a gas stored under pressure, supplemented at the time of use by the addition of high-temperature combustion gas products produced by the burning of a gas-generating composition. In many instances, the inflation gases are produced solely by an ignited gas-generating composition.

It is important that the proper ignition of the gas-generating composition is reliable at the time of need. Also, it is important that these devices do not become inadvertently inflated when they are not needed.

A trigger device, commonly known as a header, is typically utilized to ignite a primer, or propellant, which in turn ignites the gas-generating composition. A header can include a conductive pin, surrounded by an insulative layer, that terminates on a thin bridge wire that traverses the insulative layer. When an electric current is passed to the conductive pin, the current passes to the bridge wire which rapidly heats due to its electrical resistance. This heat ignites the propellant, which subsequently ignites the gas-generating composition.

When compressed gas is used as an inflation gas, the heated bridge wire can ignite a primer which ruptures a compressed gas cylinder to allow the compressed gas to expand and inflate the air bag. Typically, the passenger side of an automobile uses the compressed gas inflation system.

The resistance and integrity of the bridge wire must be accurately controlled to assure proper and safe performance of the air bag device. Hence, the uniformity of the cross-sectional area and length of the bridge wire must be tightly controlled for accurate and reliable ignition of the propellant. Known headers suffer from many shortcomings in this respect.

To achieve acceptable uniformity and reliability, the conductive pin should be centered in the header within a true position tolerance of about 0.003 inch diameter (0.076 mm). That is, the true center of the pin should not deviate from the true center of the circumference of the header by more than about 0.0015 inch (0.038 mm). Proper centering of the conductive pin assures the proper resistance of the bridge wire. However, it is difficult to consistently achieve such reliably accurate tolerance levels in a large scale manufacturing environment.

Prior art headers typically utilize a glass composition formed from powdered glass for the insulative layer surrounding and sealing the conductive pin. One of the problems associated with using a powdered glass is that gas bubbles can easily form within the glass during the subsequent fusing operation.

A ceramic substrate is typically placed over the fused glass to provide the surface for depositing the bridge wire. However, there are many problems associated with using a ceramic substrate. For example, the substrate may be non-planar with regard to the surrounding metal surface. That is, the substrate may often sit higher or lower than the metal surface by, for example, about 0.0001 inch (0.0025 mm). This condition can cause the bridge wire to shear, particularly when the powdered propellant is compressed against the bridge wire during assembly. Therefore, any such headers must be rejected.

This problem is partly due to the fact that the surrounding metal surface is softer than the ceramic substrate and is removed at a higher rate during subsequent grinding operations.

Also, epoxy is utilized to hold the ceramic substrate in place. However, epoxy is prone to drying and becoming ineffective. Since these devices should provide a useful lifetime of at least about 15 years, epoxy is an unreliable method for holding the substrate in place. Further, the use of epoxy adds a costly manufacturing step.

It would be beneficial to have a process for producing these devices and similar devices that overcomes these problems. It would be beneficial if the conductive pin could be accurately centered within the feedthrough so that the length of the bridge wire is known and could be reproduced efficiently on a large scale. The centering of a conductive pin in a sealed insulator is also useful for other purposes, such as when producing hermetic coaxial connections. Further, it would be beneficial to minimize or possibly eliminate any bubbles within the glass that can cause uneven surface conditions. It would also be advantageous if the use of epoxy was eliminated to improve the long term reliability of the device. It would also be beneficial if the metal and the insulative substrate were machined to substantially the same level to minimize the chance of shearing the bridge wire due to a difference in the relative height of the insulative substrate and surrounding metal.

SUMMARY OF THE INVENTION

The present invention provides a process for the fabrication of a hermetic coaxial feedthrough device that includes the steps of providing an eyelet having a cavity, the cavity terminating at an upper surface, and having notch means on the upper surface for engaging the end of a pin. A glass tube having a bore is placed within the cavity and a pin is inserted through the bore wherein an end of the pin engages the notch means. The glass is fused to create a substantially hermetic seal and the upper surface of the eyelet is removed to expose the fused glass.

In one embodiment of the process the device is a header. In another embodiment, a bridge wire is placed across the exposed fused glass to connect the pin with the eyelet. In yet another embodiment, the upper surface of the eyelet includes vent means for venting gas from a glass during fusing.

In another embodiment of the present invention, an eyelet for fabricating into a hermetic coaxial feedthrough is provided. The eyelet has an outer diameter and a bore substantially centered within the eyelet which terminates at an upper surface of the eyelet. Notch means on the upper surface of the eyelet can engage the end of a pin to substantially center the pin within the eyelet. The eyelet can also include vent means for venting gas from a glass contained within the bore during a fusing operation.

The present invention also provides a fixture for glass fusing operations having a bottom portion with a plurality of wells adapted to receive the upper surface of a header assembly and a top portion having a hole adapted to receive a pin and keep the pin from substantially moving. Preferably, the fixture is fabricated from graphite.

BRIEF DESCRIPTION OF THE DRAWINGS

FIG. 1 illustrates a top and cutaway side view of an eyelet produced according to an embodiment of the present invention.

FIG. 2 illustrates cutaway side views of pin, glass and eyelet components useful in the practice of the present invention.

FIGS. 3*a* and 3*b* illustrate the top and bottom portions of a fusing fixture according to an embodiment of the present invention.

DESCRIPTION OF PREFERRED EMBODIMENTS

Figure 4:
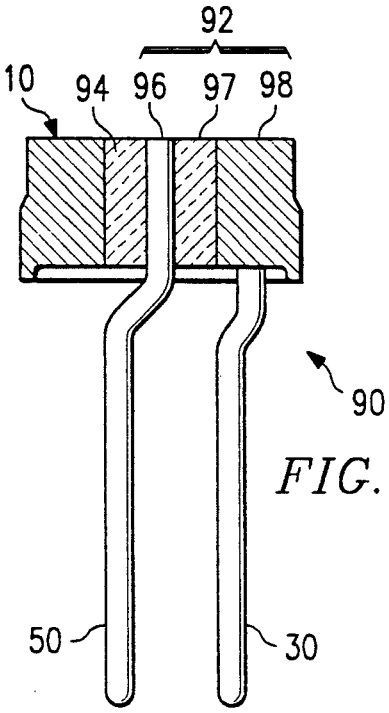
FIG. 4 illustrates a cutaway side view of hermetic coaxial feedthrough produced according to the present invention.

Referring to FIG. 1, two views of an eyelet 10 are illustrated. The eyelet 10 can preferably be fabricated from any conductive metallic material. More preferably, the eyelet 10 is fabricated from stainless steel. Stainless steel is resistant to rust and corrosion, which is advantageous when the device should perform after being subjected to a range of conditions, for example extreme temperature and humidity, over a long period of time. Further, stainless steel can advantageously create a strong compression seal when used with certain glass compositions, as is discussed hereinbelow. Preferably, the stainless steel is weldable, such as a type 304L stainless steel. Other useful metallic materials include, for example, cold rolled mild steel.

The eyelet 10 has an outer diameter 12 and a cavity 16. The cavity 16 does not extend through the entire length of the eyelet 10, but terminates leaving an upper surface 22. The upper surface 22 preferably has a thickness of from about 0.005 inch to about 0.013 inch (0.13 mm to about 0.33 mm), more preferably from about 0.008 inch to about 0.010 inch (0.20 mm to about 0.25 mm).

According to the present invention, the eyelet 10 advantageously includes a notch 18 on the upper surface 22 of the eyelet 10 that is adapted to receive the end 52 of a pin 50 (FIG. 2). In a preferred embodiment, the notch 18 is substantially centered with reference to the outer diameter 12 of the eyelet 10. The notch 18 can be accurately centered with regard to the outer diameter 12 on the upper surface 22 by known machining operations. Preferably, the notch 18 is centered to within a true position tolerance of about 0.002 inch diameter (0.051 mm.), with reference to the outer diameter 12. As used herein, true position is as defined in the American National Standard Dimensioning and Tolerancing (ANSI Y14.5M-1982), incorporated herein by reference in its entirety. Although the notch 18 is illustrated in FIG. 1 as a hole through the upper surface 22 of the eyelet 10, the notch 18 may be, for example, a depression that is adapted to receive an end of a conductive pin. During assembly, the notch 18 receives and engages the pin 50 and preferably substantially centers the end 52 of the pin 50 within the eyelet 10.

In one embodiment of the present invention, the eyelet 10 also includes vent holes 17 on the upper surface 22 of the eyelet 10. Although the vent holes 17 are illustrated in FIG. 1 as a plurality of circular holes, the vent hole may take any useful form, such as a slot or the like. The purpose of the vent holes 17 is to permit gases to escape from the glass during the fusing operation discussed hereinbelow. This advantageously reduces the number of pores or bubbles that can form and remain in the glass during fusing, particularly near the upper surface 22. It has been found that the inclusion of the vent holes 17 substantially increases the acceptable yield of devices.

The vent holes 17 should preferably be small enough to permit the surface tension of the glass to substantially keep the glass from flowing through the holes during the fusing operation. The vent holes 17 can, for example, be drilled or pierced with a tool and die set.

Referring to FIG. 2, a ground pin 30 is preferably attached to the lower surface 20 of the eyelet 10. When the device is a header or a similar device, the ground pin 30 advantageously functions as an electrical ground. Preferably, the ground pin 30 is resistance welded onto the eyelet 10. Resistance welding creates less "splatter," creates a stronger weld joint and a more consistent weld than, for example, arc percussive welding. In one embodiment, the process can advantageously be automated using a substantially straight ground pin and bending the pin after the welding operation. The ground pin 30 is preferably fabricated from stainless steel, such as type 304L.

After welding, the eyelet 10 is preferably inspected to ensure that the weld is sufficiently strong. An axial strength of at least about 40 pounds force is preferred. Glass tubing 40 is then placed within the cavity 16 of the eyelet 10. Preferably, the glass tubing 40 is substantially free from large bubbles or pores. More preferably, any bubbles within the glass are less than about 0.015 inches (0.38 mm) in diameter. The glass tubing utilized in the present invention should be substantially free of pores, although some pores can form during fusing and be present in the final product.

In one embodiment, the glass 40 is a substantially optically clear soda-lime-silicate glass having a thermal expansion coefficient of from about $90\times10^{-7}$ per °C. to about $100\times10^{-7}$ per °C., more preferably about $93\times10^{-7}$ per °C. Soda-lime-silicate glass is also preferred according to the present invention due to its relatively low cost. Also, soda-lime-silicate glass has a thermal expansion that is lower than stainless steel.

According to the present invention, it is preferable that the glass 40 have a thermal expansion coefficient that is lower than the surrounding eyelet 10. For example, an eyelet 10 with a thermal expansion coefficient of about 2 times the thermal expansion coefficient of the glass 40 can advantageously be used. This will cause a compression seal to form when cooling the eyelet and glass from the fusing temperature. Glasses other than soda-lime-silicate can be used for this purpose, as is known to those skilled in the art. For example, alkali-lead-silicate glasses may be utilized. Further, borosilicate glasses having thermal expansion coefficients of about $40\times10^{-7}$ per °C. can be utilized. Borosilicate glasses can be advantageous since these glasses can form a strong seal with certain types of metals, such as ASTM F-15, a common iron-nickel-cobalt alloy.

Glass tubing has significant advantages over pressed powdered glass. Pores, or bubbles, in the final product are advantageously reduced when a substantially pore free glass tube is utilized. Pores in the glass, particularly near the surface, can lead to shear of the bridge wire, as is discussed hereinbelow. Glass tubing is also easier to handle than glass powder or the like, and can reduce manufacturing costs.

The glass tube 40 also includes a bore 42 adapted to receive the conductive pin 50. After the glass tube 40 is placed in the eyelet 10, the conductive pin 50 is placed within the bore 42 of the glass tube 40. The upper end 52 of the conductive pin 50 engages the notch 18, and is thereby substantially centered within the eyelet 10.

Thus, the notch 18 of the eyelet 10 can advantageously self-center the pin 50 within the eyelet 10. This is an efficient method of centering the pin 50 with a high degree of reliability and low cost.

The conductive pin 50 preferably has a thermal expansion coefficient relatively close to that of the glass 40. For example, when soda-lime-silicate glass is used, the pin may preferably be made from a material corresponding to ASTM F-30, an iron-nickel alloy having a thermal expansion coefficient of about $100\times10^{-7}$ per °C. Other materials may be used depending on the thermal expansion coefficient of the glass. The conductive pin 50 should not place significant stress on the glass 40 during heating and cooling.

In one embodiment of the present invention, the pin 50 is preferably plated with nickel before assembly. For example, the pins may be barrel plated by loading them into a barrel with an electrolyte. After plating, the pin can be annealed at 800° C. in a forming gas to relieve stress and densify the plating. The nickel plating will advantageously lead to improved corrosion resistance of the iron-nickel alloy pin and improve the plating properties of the pin.

After assembling the components as described above, the glass is fused to create a substantially hermetic seal between the glass and the metal components. As used herein, the term fused refers to the process of heating the glass to a temperature equal to or above the softening point of the glass to allow the glass to viscous flow or creep.

In one embodiment of the present invention, the fusion operation is assisted by the use of a fixture for maintaining the parts of the assembly substantially in alignment. Referring to FIG. 3*a*, which shows the bottom portion of the fixture, the fixture includes a lower portion 70 having a plurality of depressions 72 adapted to receive and secure the eyelet 10 (FIG. 1), such that the upper surface 22 (FIG. 1) of the eyelet 10 (FIG. 1) engages the lower surface 74 of the depression 72 and rests therein.

Referring to FIG. 3*b*, individual fixture caps 80 are placed over the assemblies to secure the ends of the pins and keep the pins from moving significantly during fusing. The fixture caps 80 preferably include a pair of holes 82 that are adapted to fit over the ends of the conductor pins 50 (FIG. 2) and ground pin 30 (FIG. 2) when the fixture cap 80 is placed over the fixture bottom 70 (FIG. 3*a*). This configuration advantageously provides a means for keeping the conductor pin 50 (FIG. 2) centered and substantially stationary during the fusing process.

The fixture components 70 and 80 are preferably fabricated from graphite. Graphite is preferred since graphite is inexpensive and is relatively easy to machine. Further, graphite is relatively inert, and the glass does not substantially wet the graphite surface if the glass should come into contact with the graphite.

The fixture, which preferably includes a plurality of the eyelet assemblies, is placed in a furnace. When soda-lime-silicate glass tubing is used, the glass tube 40 (FIG. 2) is preferably fused by heating to a temperature of at least about 900° C., preferably from about 950° C. to about 1000° C., and more preferably about 975° C. The fusion temperature may vary according to the composition of the glass, as is known to those skilled in the art. Preferably, a dry nitrogen atmosphere is used during fusion of the glass. Alternatively, other inert gases such as argon can be used so that the stainless steel does not substantially oxidize.

The complete cycle of heating the fixture containing the eyelet assemblies and cooling the fixture back to room temperature can occur fairly rapidly. In one embodiment according to the present invention, the complete cycle takes about 30 minutes.

After the fixture has cooled, the caps 80 (FIG. 3*b*) are removed and the fused assemblies are removed from the lower portion 70 (FIG. 3*a*) of the fixture. The assemblies can then be inspected for defects and rejected as appropriate. After inspection, the fused assemblies can optionally be cleaned with a stainless steel brightener to improve the surface characteristics and appearance of the header assembly.

The fusing and cooling process creates a substantially hermetic seal between the eyelet 10 (FIG. 2) and the glass 40 (FIG. 2). Since the thermal expansion of, for example, soda-lime-silicate glass, is about $93\times10^{-7}$ per °C. and the thermal expansion of, for example, stainless steel, is about $170\times10^{-7}$ per °C., a high compression seal is formed within the device. That is, the higher expansion eyelet compresses the glass during the cooling step. This advantageously creates a strong bond between the glass and the metal components.

This is particularly important when the device is used as an air bag header since the strength of the conductive pin within the glass (the "pull strength") is important. A high pull strength results in a lower probability that the propellant explosion will inadvertently blow the pin out of the device, resulting in decreased pressure of gas in the air bag. Better pull strength also allows the explosive material to be compacted at a higher pressure against the header assembly. Preferably, the pull strength of the conductive pin exceeds about 40 pounds of force.

After the fusion process, the insulative glass must be exposed at the upper surface 22 of the eyelet 10 (FIG. 2). Thus, the upper surface 22 of the eyelet 10 must be removed. This is preferably achieved by a machining process. As used herein, the term "machining", or "machined", can refer to the processes of grinding, lapping, polishing or milling, but is not limited to these operations. In one embodiment of the invention, the upper surface 22 of the eyelet is ground to expose the fused glass therein. The grinding can be achieved using silicon carbide (SiC) grit (for example, about 180 grit) on a conventional wheel. Other techniques, or a combination of techniques, may also be used such as lapping, wherein a free abrasive slurry or paste of abrasive is used, or polishing using finer free abrasives.

FIG. 4 illustrates a cross section of a hermetic coaxial feedthrough 90 according to an embodiment of the present invention. The glass 94 is fused to the eyelet 10 to create a substantially hermetic seal. The upper surface 92 comprises the eyelet surface 98, fused glass surface 97 and the conductive pin end 96, and is substantially smooth, having been treated by the machining operation described hereinabove. In a preferred embodiment of the invention, the surface 92 has a roughness of less than about 12 microinches Ra (average of all points) as measured using a Federal 4000 profilometer (Federal Products Corp., Providence, R.I.) with a 0.0002 inch radius stylus. There is no substantial change in the planar surface level at the intersection of the glass surface 97 and eyelet surface 98.

As a result of the foregoing process, the conductive pin 50 is substantially centered within the eyelet 10. The position of the exposed end 96 of the conductor pin 50 is determined by the location of the notch 18 (FIG. 1) on the upper surface of the eyelet 10. The location of the notch 18 (FIG. 1) can be precisely located on the eyelet 10 with regard to the outer diameter 12 (FIG. 1) of the eyelet by known machining operations. This allows accurate compliance to the true position requirement for the pin.

As a result of the process of the present invention, it is possible to produce feedthroughs wherein the conductor pin is centered within the device to a true position tolerance of about 0.003 inch diameter (0.076 mm.) or less. It is not believed that such precision has heretofore been possible in a commercially viable process. The present process therefore increases the yield of acceptable devices over processes known heretofore.

An electrical assembly produced according to this process can be utilized in a number of applications, including coaxial applications wherein the centering of the conductive path is critical to the electrical characteristics of the device. The hermeticity of the glass to metal seal makes the device and process particularly applicable to hermetic applications, such as in microwave packages.

Figure 5:
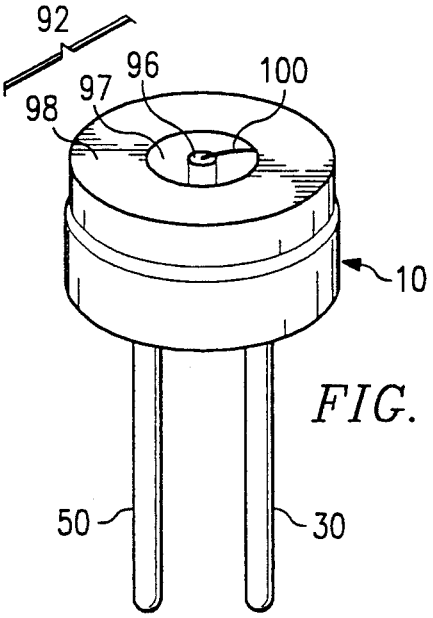
FIG. 5 illustrates a perspective view of a header produced according to an embodiment of the present invention.

Referring to FIG. 5, when the device is an air bag header or similar device, a bridge wire 100 can be applied to the fused glass surface 97 after the device has been sufficiently machined. The bridge wire 100 can advantageously be applied by a plating process and traverses the fused glass surface 97 to connect the end 96 of the conductive pin 50 to the eyelet surface 98. In this respect, the smoothness and levelness of the upper surface 92 that is consistently obtainable is advantageous to the present invention. Typically, the bridge wire 100 has a diameter of from about 0.0008 to about 0.0013 inches (0.020 to 0.033 mm). Deviations in the finish of the upper surface 92 can substantially affect the yield of acceptable headers.

Additionally, the lower ends of the conductive pin 50 and the ground pin 30 can be gold plated. Gold plating advantageously provides improved electrical characteristics to the pins.

The process and device of the present invention offer a number of advantages over the prior art. As discussed above, the present process can allow for compliance to a true position requirement for the conductor pin of within about 0.003 inch diameter (0.076 mm) of true center with regard to the outer circumference of the eyelet, regardless of the feature size on the center lead pin. Further, when an optically clear glass is used for the insulator quality control improves and costs can be reduced. Since the upper surface of the header is substantially smooth, the production yield of headers with acceptable bridge wires is increased. When vent means are utilized in the eyelet of the present invention, the probability of bubbles near the surface of the fused glass decreases and the production yield is further increased. The process of the present invention also enhances the pin ejection safety margins due to the strength of the compressive seal.

Figure 6:
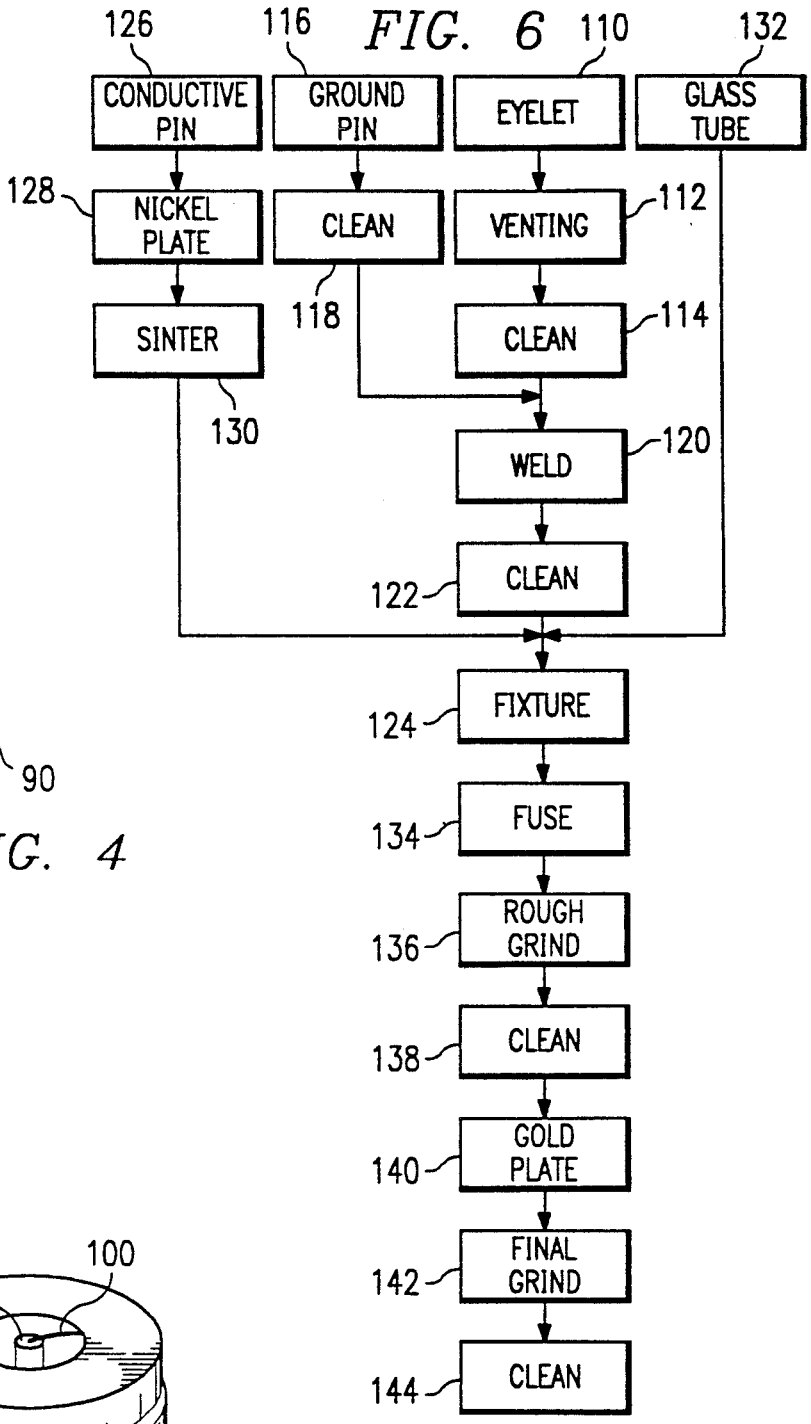
FIG. 6 illustrates a flow chart of one embodiment of the process according to the present invention.

FIG. 6 illustrates a preferred embodiment of the process according to the present invention. An eyelet 110, substantially as described above, is provided. Vent holes are punched 112 in the eyelet 110 and the eyelet 110 is then cleaned 114.

A ground pin 116, having been cleaned 118, is welded 120 to the eyelet 110 by a resistance welding technique. The eyelet/ground pin assembly is then cleaned 122 and placed in a fixture 124.

Meanwhile, a conductive pin 126 is nickel plated 128 in a barrel plating process. The nickel plated conductive pins are then sintered 130 at about 800° C. to relieve stresses and densify the plating.

A glass tube 132 is placed in the bore of the eyelet 110 and the conductive pin 126 is placed within the center bore of the glass tube 132. The top of the fixture assembly is then placed over the bottom of the fixture assembly to secure the assemblies.

The fixture is then placed into a furnace for the fusing process 134. After fusing, the assemblies are rough ground 136 to remove the upper surface of the eyelet 110 The assembly is then cleaned 138 and the conductive pin 126 and ground pin 116 can be gold plated 140. A final grinding step 142 ensures the smoothness of the upper surface of the eyelet assembly. Thereafter the assemblies are cleaned 144 and are ready for shipment.

EXAMPLE

A stainless steel eyelet (type 304L stainless steel with a thermal expansion coefficient of about $170\times10^{-7}$ per °C.) is provided having an outer diameter of about 0.288 inch and a cavity having a diameter of about 0.120 inch. Centered on the upper surface of the eyelet to within a true position tolerance of about 0.002 inch diameter is a notch having a diameter of about 0.040 inches. Four vent holes are drilled into the upper surface and above the cavity of the eyelet to provide venting means for subsequent fusing operations. The vent holes have a diameter of about 0.020 inches.

A stainless steel (type 304L) ground pin is welded to the bottom surface of the eyelet by a resistance welding technique. The pin then has an axial pull strength of about 40 pounds force.

Soda-lime-silicate glass tubing having an outer diameter of about 0.116 inch and an inner bore having a diameter of about 0.042 inch is placed within the cavity of the eyelet. The glass tubing has a length of about 0.138 inch. The glass is an optically clear soda-lime silicate glass that is substantially free of foreign material, glass particulates and bubbles. The glass has a thermal expansion coefficient of about $93\times10^{-7}$ per °C.

A conductive pin having a diameter of about 0.040 inch is placed within the center bore of the glass. The conductive pin is fabricated from an iron-nickel alloy (ASTM F-30) that has been nickel plated for corrosion resistance and weldability. The conductive pin has a thermal expansion coefficient of about $100\times10^{-7}$ per °C. The end of the conductive pin engages the notch and substantially self-centers within the eyelet.

This assembly is placed in a graphite fixture and placed in a furnace at substantially room temperature. The graphite fixture engages the pins and prevents the conductive pin from substantially shifting during fusing. The furnace is rapidly heated to about 975° C. and then cooled to room temperature. The entire heating cycle takes about 30 minutes.

The fused assemblies are removed from the fixture and taken to a machining operation. The lower surface of the eyelet is then removed to expose the glass using a 180 grit silicon carbide conventional grinding wheel. After cleaning, the pins can be gold plated.

The machined surface of the coaxial feedthrough has a surface roughness of about 10 microinches Ra. The center conductive pin has a pull strength of greater than about 40 pounds and is centered within the eyelet to a true position tolerance of about 0.003 inch diameter. The device is substantially hermetic. The device can then have a bridge wire plated or welded across the top surface for use as a header.

While various embodiments of the present invention have been described in detail, it is apparent that modifications and adaptations of these embodiments will occur to those skilled in the art. However, it is to be expressly understood that such modifications and adaptations are within the spirit and scope of the present invention.

What is claimed is:

1. A process for the fabrication of a hermetic coaxial feedthrough device, comprising the steps of:

a) providing an eyelet comprising a cavity, said cavity terminating at an upper surface, and further comprising notch means on said upper surface for engaging the end of a pin;

b) placing a glass tube substantially within said cavity, said glass tube defining a bore therethrough;

c) inserting a pin through said bore wherein an end of said pin engages said notch means;

d) fusing said glass to create a substantially hermetic seal; and e) removing said upper surface of said eyelet to expose said fused glass.

2. A process as recited in claim 1, wherein said device is a header.

3. A process as recited in claim 2, further comprising the step of placing a bridge wire across said exposed fused glass to connect said pin with said eyelet.

4. A process as recited in claim 1, wherein said eyelet has a thermal expansion coefficient greater than the thermal expansion coefficient of said glass.

5. A process as recited in claim 1, wherein said eyelet is fabricated from stainless steel.

6. A process as recited in claim 1, wherein said glass is substantially free of bubbles.

7. A process as recited in claim 1, wherein said glass is a soda-lime-silicate glass.

8. The process as recited in claim 1, wherein said glass has a thermal expansion coefficient of from about $90\times10^{-7}$ per °C. to about $100\times10^{-u}$ per °C.

9. A process as recited in claim 1, wherein said glass is substantially optically clear.

10. A process as recited in claim 1, wherein said conductive pin has a thermal expansion coefficient substantially equal to the thermal expansion coefficient of said glass.

11. A process as recited in claim 1, wherein said step of removing said upper surface comprises the step of grinding said upper surface.

12. A process as recited in claim 1, wherein said process further comprises the step of polishing said exposed fused glass.

13. A process as recited in claim 1, wherein said step of removing said upper surface comprises the step of machining said fused glass to a roughness of less than about 12 microinches Ra.

14. A process as recited in claim 1, further comprising the step of welding a ground pin to said eyelet to form a ground connection.

15. A process as recited in claim 1, wherein said upper surface further comprises vent means.

16. A process as recited in claim 15, wherein said vent means comprise a plurality of holes.

17. A process as recited in claim 1, wherein said fused glass has a maximum bubble size of about 0.015 inches.

18. A process as recited in claim 1, wherein said pin has a pull strength of at least about 40 pounds force.

19. A process as recited in claim 1, wherein said fusing step comprises the step of heating said glass to a temperature of from about 900° C. to about 1000° C.

20. A process as recited in claim 1, wherein said fusing step comprises the steps of:

a) placing said eyelet, said pin and said glass in a bottom portion of a fixture adapted to receive said eyelet; and b) placing a top portion of said fixture over said bottom portion whereby a hole in said top portion engages said pin to prevent substantial movement of said pin.

21. A process as recited in claim 1, wherein said upper surface has a thickness of from about 0.005 inches to about 0.013 inches.

22. A hermetic coaxial feedthrough device produced by a process as recited in claim 1, wherein said feedthrough device comprises a top surface defined by said eyelet, said glass and an end of said pin and said top surface has a roughness of less than about 12 microinches Ra.

23. A hermetic coaxial feedthrough device as recited in claim 22, wherein said pin has a pull strength of at least about 40 pounds force.

24. A process for the fabrication of a header, comprising the steps of:

a) providing an eyelet having an outer diameter and a cavity, said cavity terminating at an upper surface, said upper surface comprising vent means for venting gas and notch means for engaging the end of a pin;

b) placing a glass tube into said cavity, said glass tube defining a bore therethrough and said glass tube having a thermal expansion coefficient that is lower than the thermal expansion coefficient of said eyelet;

c) inserting a conductive pin through said bore wherein an end of said conductive pin engages said notch means;

d) fusing said glass to create a substantially hermetic seal;

e) removing the lower surface of said eyelet to expose said glass; and f) connecting said end of said pin with said eyelet by placing a bridge wire on said glass.

25. A process as recited in claim 24, wherein said eyelet comprises stainless steel and said glass comprises soda-lime-silicate glass.

26. A process as recited in claim 25, wherein said glass has a thermal expansion coefficient of from about $90\times10^{-7}$ per °C. to about $100\times10^{-7}$ per °C.

27. A process as recited in claim 25, wherein said glass has a maximum bubble size of less than about 0.015 inches.

28. A process as recited in claim 25, wherein said fusing step comprises heating said glass to a temperature of from about 900° C. to about 1000° C. in a substantially nonoxidizing atmosphere.

29. A process as recited in claim 24, further comprising the step of welding a ground pin onto said eyelet.

30. A process as recited in claim 24, wherein said conductive pin has a pull strength of at least about 40 pounds force when fused in said glass.

31. A process as recited in claim 24, wherein said removing step comprises the step of machining said exposed glass, said end of said pin and said eyelet to a roughness of less than about 12 microinches Ra.

32. A header produced by a process as recited in claim 31.

33. A header produced by a process as recited in claim 31, wherein said conductive pin has a pull strength of at least about 40 pounds force when fused in said glass.

34. A process for the fabrication of a header, comprising the steps of:

a) providing an eyelet comprising:

i) an outer diameter;

ii) a cavity terminating at an upper surface;

iii) notch means substantially centered on said upper surface for engaging a pin; and iv) vent means on said upper surface for venting a gas;

b) attaching a ground pin to said eyelet;

c) placing a glass tube defining a bore therethrough substantially within said cavity, wherein said glass tube is substantially free from bubbles having a diameter of greater than about 0.015 inches and having a thermal expansion coefficient lower than the thermal expansion coefficient of said eyelet;

d) inserting a conductive pin through said bore wherein and end of said conductive pin engages said notch means and substantially self-centers within said eyelet;

e) placing said eyelet, said ground pin, said glass and said conductive pin into a fixture, said fixture comprising means for engaging said conductive pin;

f) heating said fixture to fuse said glass in a substantially non-oxidizing atmosphere and form a fused blank;

g) cooling said fixture and removing said blank from said fixture; and h) machining said blank to remove said upper surface therefrom and expose said fused glass.

35. A process as recited in claim 34, wherein said eyelet comprises stainless steel.

36. A process as recited in claim 35, wherein said glass comprises soda-lime-silicate glass.

37. A process as recited in claim 34, wherein said fused glass is substantially optically clear.

38. A process as recited in claim 34, wherein said machining step comprises the step of machining said fused glass to a roughness of less than about 12 microinches Ra.

39. A header produced by a process as recited in claim 38.

40. An eyelet for fabricating into a hermetic coaxial feedthrough, comprising:

a) an outer diameter;

b) a bore substantially centered within said eyelet, said bore terminating at an upper surface of said eyelet;

c) notch means on said upper surface of said eyelet for engaging the end of a pin to center said pin within said eyelet; and d) vent means for venting gas from a glass contained within said bore during a fusing operation.

41. An eyelet as recited in claim 40, wherein said eyelet comprises stainless steel.

42. An eyelet as recited in claim 40, wherein said eyelet consists essentially of stainless steel.

43. An eyelet as recited in claim 40, wherein said upper surface has a thickness of from about 0.005 inches to about 0.013 inches.

44. An eyelet as recited in claim 40, wherein said notch means comprises a substantially circular opening centered on said upper surface within a true position tolerance of about 0.002 inches diameter.

* * * * *